US006298827B1

(12) United States Patent
Desai et al.

(10) Patent No.: US 6,298,827 B1
(45) Date of Patent: Oct. 9, 2001

(54) METHOD AND SYSTEM TO MONITOR AND CONTROL THE ACTIVATION STAGE IN A HYDRAULICALLY ACTUATED DEVICE

(75) Inventors: Chetan J. Desai, Bloomington; David L. Fuelberth, Metamora, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/521,285

(22) Filed: Mar. 8, 2000

(51) Int. Cl.[7] ..... F02M 33/04

(52) U.S. Cl. ..... 123/446; 123/494; 73/119 A

(58) Field of Search ..... 123/446, 494; 73/119 A; 324/207.11, 207.13, 207.15, 207.16

(56) References Cited

U.S. PATENT DOCUMENTS

| | | | |
|---|---|---|---|
| 4,503,820 | 3/1985 | Nakagawa . | |
| 4,622,942 | 11/1986 | Nozaki et al. . | |
| 5,144,928 | 9/1992 | Komurasaki . | |
| 5,150,696 | 9/1992 | Kabasin et al. . | |
| 5,191,867 | 3/1993 | Glassey . | |
| 5,233,962 | 8/1993 | Fodale et al. . | |
| 5,284,118 | 2/1994 | Kato et al. . | |
| 5,313,924 | 5/1994 | Regueiro . | |
| 5,423,302 | 6/1995 | Glassey . | |
| 5,483,937 | 1/1996 | Firey . | |
| 5,564,391 | 10/1996 | Barnes et al. . | |
| 5,586,538 | 12/1996 | Barnes . | |
| 5,606,959 | 3/1997 | Maki et al. . | |
| 5,634,448 | 6/1997 | Shinogle et al. . | |
| 5,636,601 * | 6/1997 | Moriya et al. | 251/129.01 |
| 5,653,210 | 8/1997 | Fischer et al. . | |
| 5,708,355 * | 1/1998 | Schrey | 324/201.16 |
| 5,743,233 | 4/1998 | Unland et al. . | |
| 5,747,684 | 5/1998 | Pace et al. . | |
| 5,749,346 | 5/1998 | Halvorson et al. . | |
| 5,839,420 | 11/1998 | Thomas . | |
| 5,964,192 * | 10/1999 | Ishii | 251/129.01 |

FOREIGN PATENT DOCUMENTS

WO 97/12136 4/1997 (WO) .

* cited by examiner

*Primary Examiner*—Thomas N. Moulis
(74) *Attorney, Agent, or Firm*—Liel & McNeil

(57) ABSTRACT

A method of adjusting performance of an electronically controlled hydraulic system comprises the initial step of providing at least one electronically controlled hydraulic device having a control valve member operably coupled to an electronic actuator. The control valve member impacts a seat when the device is activated and de-activated. The electronically controlled hydraulic device is then activated according to an activation profile. The seat impacts of the control valve member are detected and recorded. The detected seat impact characteristics are compared to expected seat impact characteristics. A subsequent activation profile is then changed if the detected seat impact characteristics are substantially different from the expected seat impact characteristics

21 Claims, 4 Drawing Sheets

METHOD AND SYSTEM TO MONITOR AND CONTROL THE ACTIVATION STAGE IN A HYDRAULICALLY ACTUATED DEVICE

TECHNICAL FIELD

The present invention relates generally to control valves for hydraulic devices, and more particularly to a system and method for monitoring and adjusting the actuation of control valves for hydraulic devices.

BACKGROUND ART

In a hydraulically actuated electronically controlled fuel injection system, the injection of fuel into the cylinder is controlled by moving a poppet valve between a high pressure seat and a low pressure seat. The poppet valve member is a portion of an overall control valve that includes an electronic actuator (usually a solenoid) and various body components that include the valve seating surfaces and define the various internal fluid passageways. In part because of the requirement that the various components that make up the control valve be manufactured with realistic tolerances, performance variations in poppet valve opening and closing from one injector to another sometimes occurs. In other words, the activation and deactivation stages of different injectors sometimes diverges substantially from an expected nominal injector performance due at least in part to machining tolerances. In general, it is desirable that a group of injectors installed in a single engine all perform in a uniform and predictable manner. One way of at least partially accomplishing this goal is to ensure that the activation stage for each injector occur in a uniform and expected manner.

The fuel-injection system is operated using an activation profile map that is based upon a predicted nominal injector performance. These activation profiles are a function of different operating conditions, such as speed, load, etc. Each activation profile includes an on-time, an off-time, and a solenoid current magnitude that may vary over the duration between the on-time and the off-time. For instance, the initial current may be a pull in current, and for the remaining duration of the injection event may only be a hold current. When current is sent to an individual injector, it responds by lifting the poppet valve member to close a low pressure seat. When the solenoid current is terminated, the poppet valve member moves back toward its biased position to close a high-pressure seat. In most instances, noise is generated when the poppet valve member impacts both its low-pressure seat and the high-pressure seat.

Since the activation stage characteristics for a nominal injector are known for a given activation profile, the amount an individual injector deviates from nominal can be estimated if the activation stage characteristics of that injector can be determined. Furthermore, if the deviation of an individual injector from the nominal can be quantified, it is conceivable that the injector's performance can be brought more into line with a nominal injector by adjusting the activation profile to compensate for measured deviations due to machining tolerances and other factors.

The present invention is corrected to these and other problems associated with monitoring and adjusting the actuation stage of hydraulically actuated devices, such as fuel injectors.

DISCLOSURE OF THE INVENTION

An electronically controlled hydraulic system includes at least one electronically controlled hydraulic device with a control valve member operably coupled to an electronic actuator. The control valve member impacts a seat when the device is activated and deactivated. An electronic control module is in communication with and capable of controlling the electronic actuator. The electronic control module has an activation profile generator and an activation profile adjuster. A control valve impact sensor is in communication with the electronic control module.

In another aspect, a method of monitoring performance of an electronically controlled hydraulic system includes the initial step of providing at least one electronically controlled hydraulic device having a control valve member operably coupled to an electronic actuator. The control valve member impacts a seat when the device is activated and deactivated. The electronically controlled hydraulic device is then activated according to an activation profile. The seat impacts of the control valve member are then detected. The detected seat impact characteristics are recorded. Finally, the detected seat impact characteristics are compared to expected seat impact characteristics.

BEST MODE OF CARRYING OUT THE INVENTION

Figure 1:
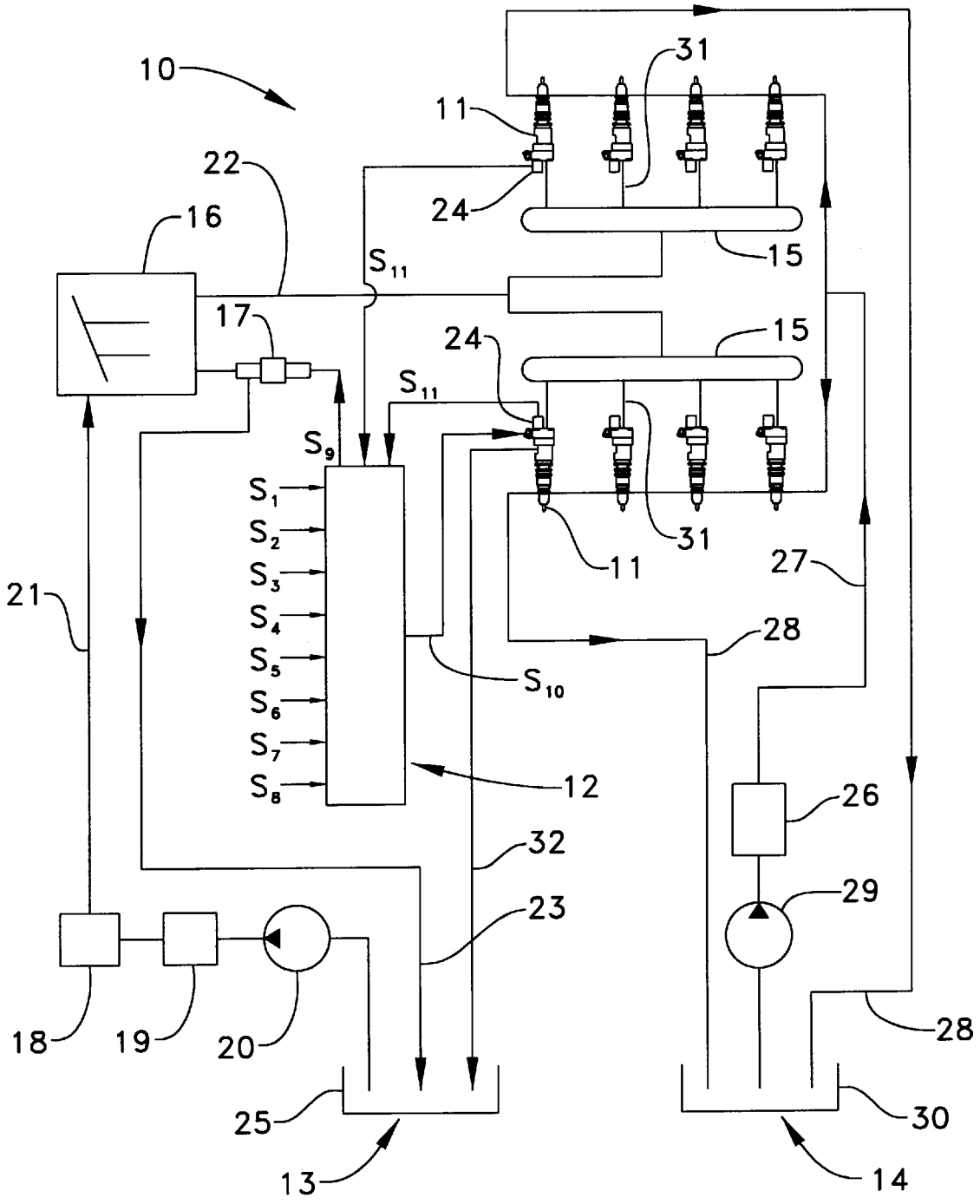
FIG. 1 is a schematic illustration of an electronically controlled hydraulically actuated fuel injection system according to the present invention.

Referring now to FIG. 1, hydraulically actuated fuel injection system 10 includes a plurality of fuel injectors 11, an electronic control module 12, an actuating fluid system 13 and a fuel supply system 14. Electronic control module 12 controls system 10 and the operation of the engine within which the system is installed. Electronic control module 12 performs this controlling function based upon a plurality of sensor inputs as $S_{8\text{-}11}$, which correspond to such perimeters as speed, mode, temperature, crank-shaft position, etc. Fuel supply system 14 includes a fuel tank 30, a fuel circulation pump 29 and a fuel filter 26. Pump 29, circulates fuel,, which is preferably distillate diesel fuel, past fuel filter 26 and on to the individual fuel injectors 11 via a fuel supply line 27. Any excess fuel is returned to tank 30 via a fuel return line 28 for recirculation. The actuator fluid system 13 preferably utilizes engine lubricating oil as the actuation fluid, and includes a low pressure actuation fluid reservoir 25, which is preferably an engine oil sump. Oil is pulled from sump 25 via a low pressure pump 20 and pushed past a filter 19, an actuation fluid cooler 18 toward a high pressure pump 16 via an actuation fluid supply line 21. High pressure pump 16 supplies high pressure oil to a pair of common rails 15 via a high pressure supply line 22. In order to control the magnitude of fluid pressure in common rails 15, a rail pressure control valve 17 returns a portion of the high pressure oil to sump 25 via a return line 23. The electronic control module 12 controls fluid pressure in rails 15 in a conventional manner by sensing the rail pressure, comparing that pressure to a desired rail pressure, and then adjusting rail pressure control valve 17 accordingly to move the pressure in the direction of the desired rail pressure. The actuation of fluid inlet of each fuel injector 11 is fluidly connected to one of the common rails 15 via a branch passage 31.

In order to monitor the activation stage of each fuel-injector 11, a control valve impact sensor 24 is preferably mounted on each injector and communicates it's signal as $S_{11}$ to electronic control module 12 in a conventional manner. After each injection event, used actuation fluid is recirculated to sump 25 from the individual fuel-injectors 11 via a drain passage 32.

Figure 2:
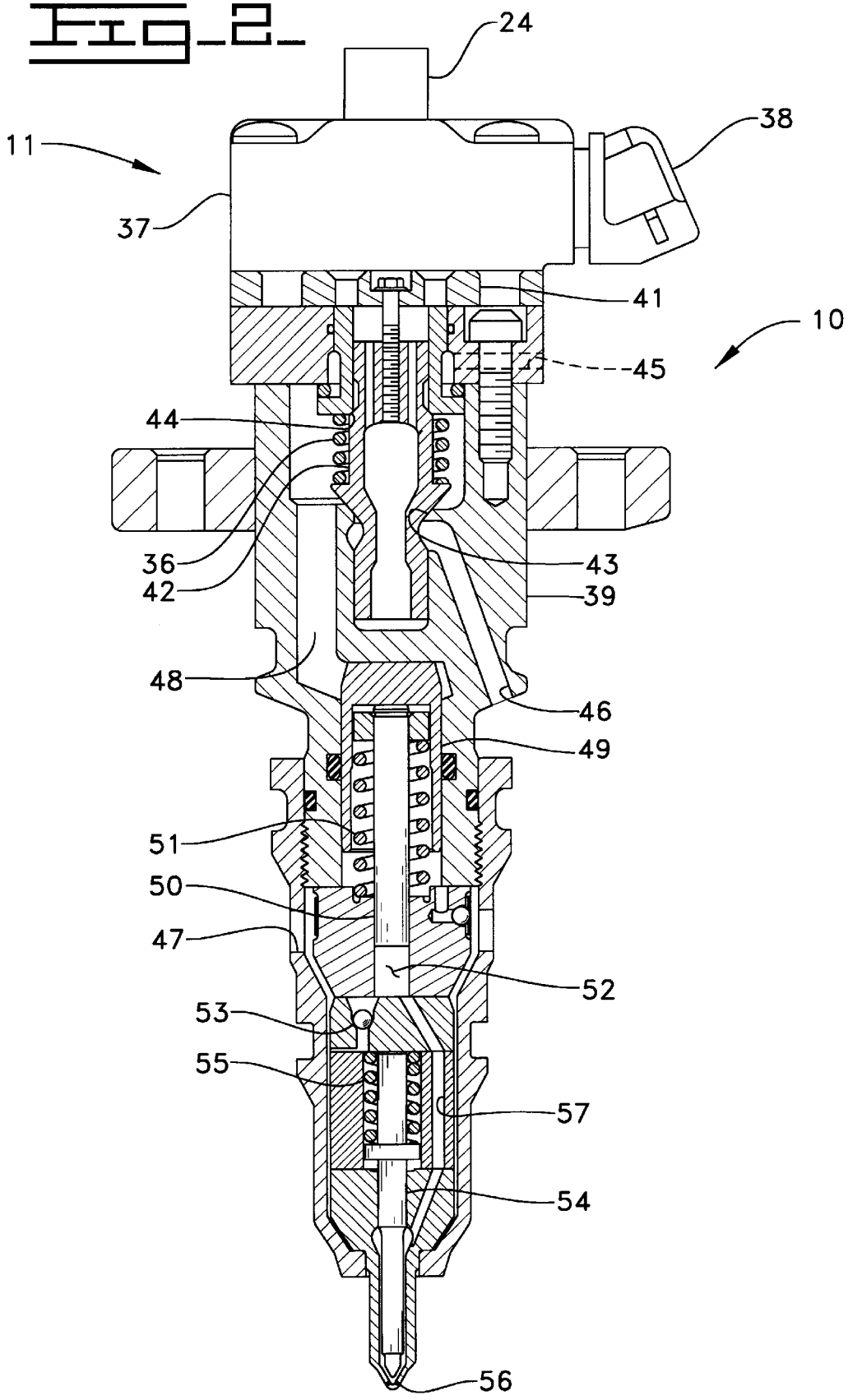
FIG. 2 is a section side diagrammatic view of an electronically controlled hydraulically actuated fuel injector according to one aspect of the present invention.

Referring now in addition to FIG. 2, each fuel-injector 11 includes an injector body 39 made up of various components attached to one a another in a manner well-known in the art. Injector body 39 includes an actuation fluid inlet 4(6 that is connected to the common rail 15 of FIG. 1 via a branch passage 31. Injector body 39 also defines a drain passage 45 that is fluidly connected to sump 25 via drain line 32. Finally, injector body 39 includes a fuel inlet 47 connected to a fuel supply line 27, as shown in FIG. 1. Fuel-injector 11 also includes an electrical connection 38 that is the means by which it receives an electrical current signal as $S_{10}$ as generated by electric module 12 of FIG. 1. Finally, a control valve impact sensor 24 is preferably mounted on the top portion of each fuel injector 11, and transmits an impact signal $S_{11}$ to electronic control module 12.

A control valve assembly 40 includes a control valve member 42 that moves between a high pressure seat 43 and a low pressure seat 44. Control valve member 42 is preferably a poppet valve member that is operably coupled to a suitable electrical actuator 37, which is preferably a solenoid but could be another actuator such as a piezo electric actuator. In the illustrated example, control valve member 42 is attached to a moveable armature 41 by a conventional fastener. Control valve member 42 is normally biased downward into contact with high pressure seat 43 by a biasing spring 36. When in this position, an actuation fluid flow passage 48 is fluidly connected to drain passage 45 past low pressure seat 44. When electrical actuator 37 is energized with sufficient current, armature 41 and control valve member 42 are lifted upward into contact with low pressure seat 44. When in this position, actuation fluid flow passage 48 is fluidly connected to high pressure actuation fluid inlet 46 past high pressure seat 43. The total movement of control valve member 42 from high pressure seat 43 to low pressure seat 44 in on the order of hundreds of microns. However, because the valve moves relatively quickly between these two positions, a significant amount of noise is generated when the valve member impacts the respective seats. This noise can be detected by control valve impact sensor 24, and the impact characteristics, including timing and intensity, are transmitted in signal $S_{11}$ to electronic control module 12 (see FIGS. 3*a* and 3*b*).

Between injection events, electrical actuator 37 is de-energized and actuation fluid flow passage 48 is opened to drain passage 45. In order to initiate an injection event, electrical actuator 37 is energized and control valve member 42 is lifted to open fluid communication between high pressure inlet 46 and actuation fluid flow passage 48. When this occurs, high pressure actuation fluid begins acting on the top hydraulic surface of an intensifier piston 49, causing it to move downward against the action of a return spring 51. A plunger 50 is operably coupled to a piston 49 and serves to compress fuel in a fuel pressurization chamber 52 when the piston and plunger are driven downward by high pressure acting on the top of intensifier piston 49.

Fuel pressurization chamber 52 is fluidly connected to nozzle outlet 56 via a nozzle supply passage 57. When fuel pressure in nozzle supply passage 57 is above a predetermined valve opening pressure, a needle valve 54 will lift to open nozzle outlet 56 to commence the spraying of fuel into the combustion space. Needle valve 54 is normally biased downward to close nozzle outlet 56 by a needle biasing spring 55. Between injection events, when plunger 50 and piston 49 are undergoing their upward return stroke, fresh low pressure fuel is drawn into fuel pressurization chamber 52 past a check valve 53.

INDUSTRIAL APPLICABILITY

Figure 4A:
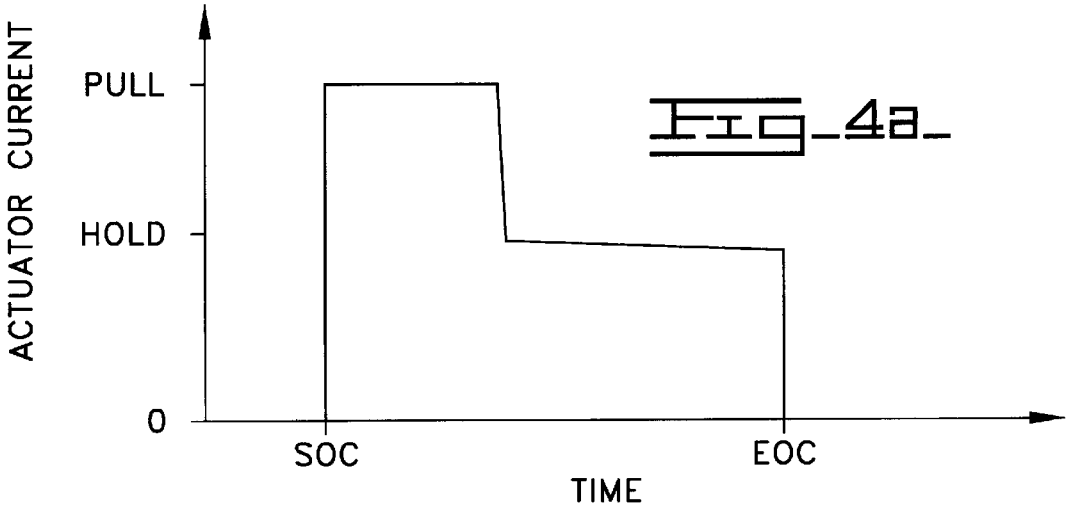
FIGS. 4*a–c* are graphs of actuator current, impact signal and injection rate, respectively, for an example nominal injection event according to one aspect of the present invention.
Figure 4B:
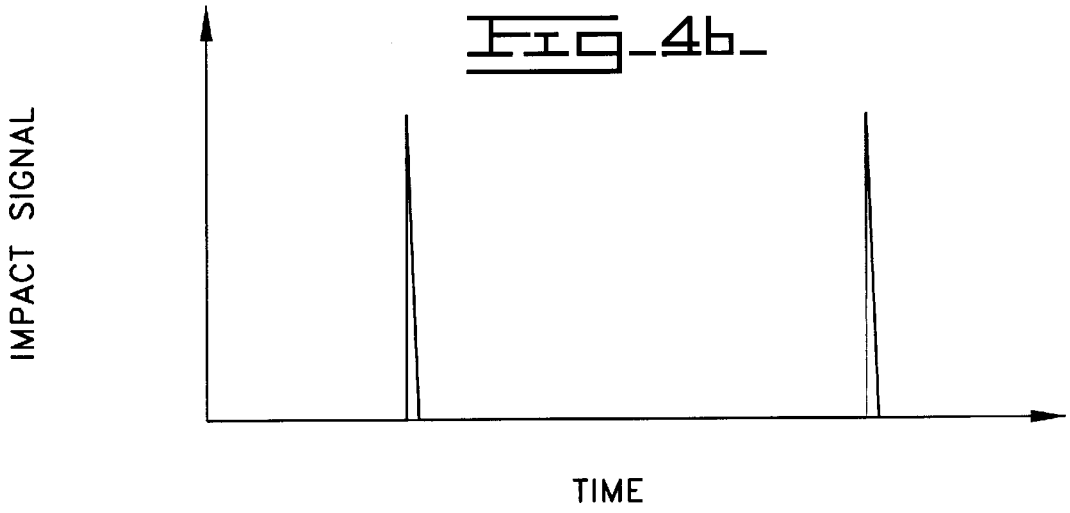

Referring now to FIGS. 2 and 4*a–c*, each injection event is initiated by sending current to fuel-injector 11 based upon an activation profile determined by the electronic control module. The activation profile, an example of which is shown in FIG. 4*a*, includes a start of current time (SOC), an end of current time (EOC), and a magnitude current profile during the injection event. In order to get armature 41 and control valve member 42 moving upward away from high pressure seat 43, a normally higher pull-in current is needed to get these components moving. After they have come to rest at the upper seat 44, the current is often lowered to a hold-in current sufficient to hold control valve member 42 in contact with low pressure seat 44 during a remaining portion of each injection event.

Figure 3A:
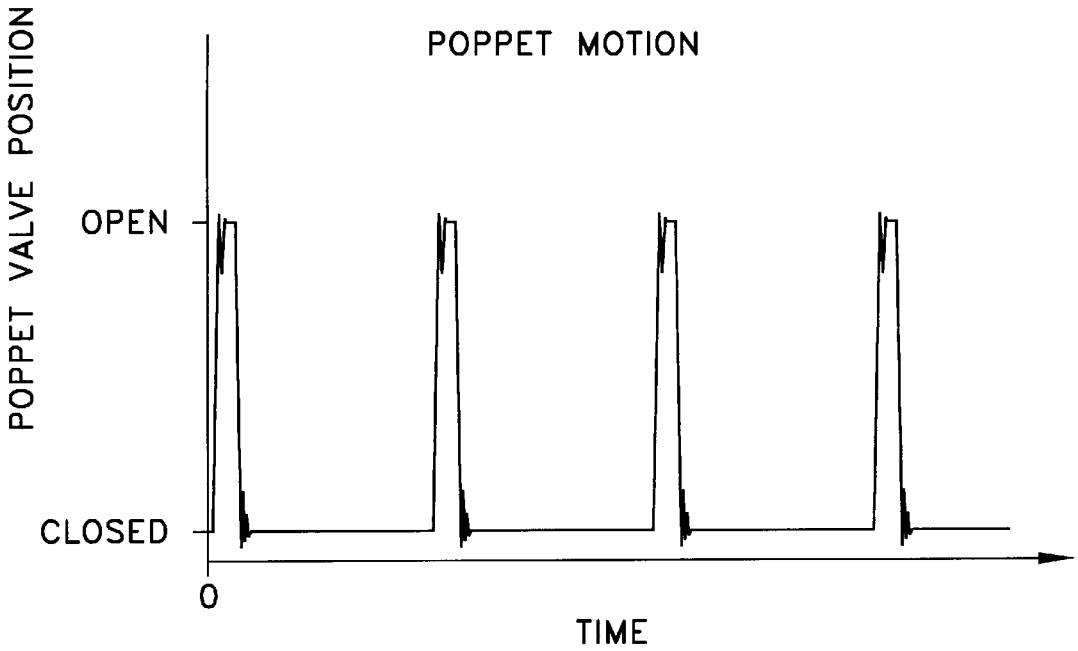
FIGS. 3*a* and 3*b* are graphs of poppet valve member position and noise sensor signal, respectively, for an individual fuel injector over a plurality of injection events.
Figure 3B:
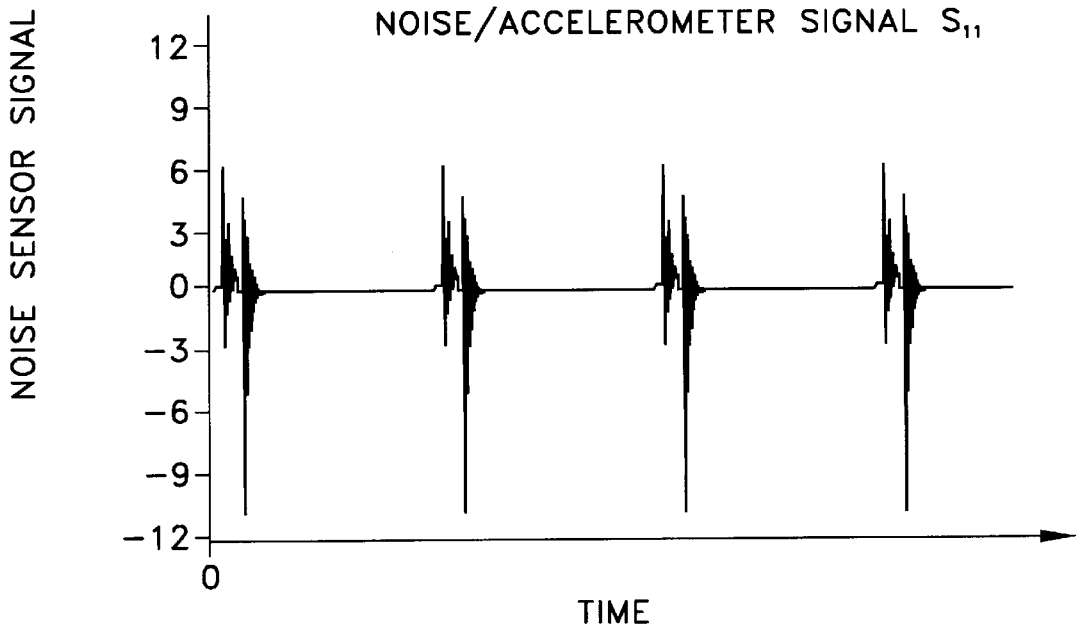
Figure 4C:
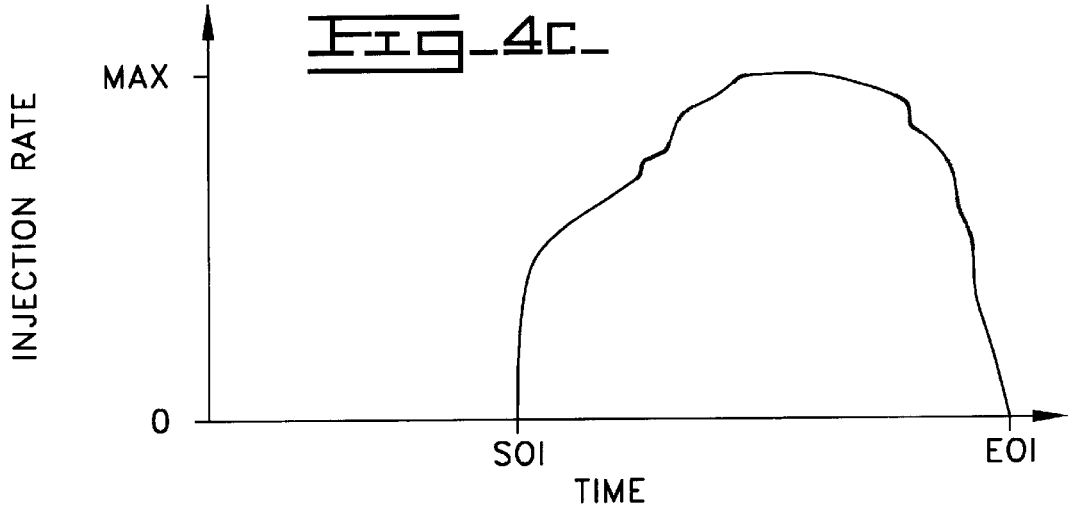

Those skilled in the art appreciate that each activation profile is generally a function of many parameters, including the engine operating condition, the common rail pressure, throttle position, crank shaft position, etc. Referring in addition to FIGS. 3*a–b*, a short time after the start of current to the electrical actuator 37, control valve member 42 impacts the low pressure seat 44. Likewise, control valve member 42 impacts high pressure seat 43 at the end of an injection event a short time after the end of current. In general, these time delays are a function of fluid viscosity, solenoid strength, the distance the valve member must move and other known causes. In other words, there are several known reasons why the control valve member does not move instantaneously with the current being supplied to the electronic actuator. FIG. 4*c* show that the actual injection of fuel into the combustion space is further delayed from the valve opening and closing events because it takes some finite amount of time for pressure to build within the injector and move the various internal components of injector 11 that cause the injection event to occur.

Referring again to FIG. 2, between injection events, no current is being supplied to electrical actuator 37, control valve member 42 is at rest closing high pressure seat 43, piston 49 and plunger 50 are in their upward retracted positions, as shown, and needle valve 54 is in its downward position closing nozzle outlet 56. At this time, low pressure prevails in actuation fluid flow passage 48, and low pressure prevails and fuel pressurization chamber 52. The injection event is initiated by sending a pull-in current to electrical actuator 37 to lift control valve member 42 upward to close low pressure seat 54 and open high pressure seat 43. When this occurs, high pressure flows into actuation fluid flow passage 48 and begins to hydraulically push piston 49 and plunger 50 downward. When this occurs, check valve 53 closes and fuel pressure in fuel pressurization chamber 52 begins to rise to injection levels. When the fuel pressure exceeds the valve opening pressure, needle valve 54 lifts to open nozzle outlet 56. When this occurs, fuel commences to spray into the combustion space. Shortly before the desired amount of fuel has been injected, current to electrical actuator 37 is terminated, which corresponds to the EOC point in FIG. 4A. When this occurs, control valve member 42 moves downward under the action of biasing spring 36 into contact to close high pressure seat 43 and open low pressure seat 44. This relieves the high pressure acting on intensifier piston 49 because actuation fluid flow passage 48 is now open to low pressure drain 45. The relieving of pressure acting on intensifier piston 49 combined with the force produced by return spring 51 causes piston 49 and plunger 50 to cease their downward stroke. When this occurs, fuel pressure in fuel pressurization chamber 52 and nozzle supply passage 57 quickly drops below a valve closing pressure. When fuel pressure drops below the valve closing pressure, needle valve 54 moves downward to close nozzle outlet 56 and end the injection event. See EOI in FIG. 4C.

Through extensive testing and mathematical modeling, the difference in time between the start of current and the start of injection is known for a nominal fuel injector. However, the actual performance characteristics of each individual injector almost always deviate from the nominal injector to some extent. Although a portion of these deviations can be attributed to the structure and functioning of the fuel injector below the control valve assembly 40, it is believed that a substantial portion of the injector performance deviation is due to deviations in the activation stage of the control valve assembly from that of a nominal fuel injector. In other words, it is believed that a majority of the injector performance deviation from a nominal injector can be attributed to differences in performance of the operation, structure and fluid flow patterns in and around the control valve assembly 40. Therefore, in order to estimate the deviation of the actual injector's performance from that of the nominal injector, the present invention contemplates a method of detecting the performance characteristics of the control valve assembly by determining when and with what intensity the control valve member impacts its respective low pressure and high pressure seats.

In the preferred embodiment this is accomplished by positioning an individual noise sensor on each individual fuel injector. However, those skilled in the art will appreciate that the noise sensor can be located in any acoustical proximity sufficient to detect the control valve impacts and still function in the way intended by the present invention. Furthermore, other types of sensors could be utilized to detect control valve impacts, such as a suitably placed accelerometer and/or a stress gauge. In addition, while the preferred version of the present invention includes an individual control impact sensor for each fuel injector, those skilled in the art will appreciate that with appropriate filtering logic, even a single appropriately positioned impact sensor could be utilized to perform the present invention. In such an instance, a noise sensor might be located at an appropriate central location on the engine head that is capable of detecting the valve impacts of several injectors, and the electronic control module could include logic to determine which injector and which seat are the source of each impact sensed. Those skilled in the art will appreciate that such a strategy is possible at least in part because of the ability of the engine components to transmit the noise generated within the fuel injectors, and because only one fuel injector is active at any given time.

At the threshold, the present invention has the ability to determine whether all of the fuel injectors installed in a given engine are functioning. For instance, if no impact is sensed after current is sent to an individual injector, that would indicate, for one reason or another, that the injector has malfunctioned. If the electronic control module senses such a condition, an alert signal could be generated to have that individual injector examined and/or replaced. Likewise, if the impact sensor senses a valve opening impact with a relatively low intensity or one in which the opening impact occurs at a substantially larger delay time period than that expected, this could be an indication that the control valve's movement is relatively sluggish or otherwise not performing correctly. For instance, during cold start conditions, substantially more current is sometimes needed in order to move the control valve member toward its open position against the resistive forces of the high viscosity cold oil that surrounds the control valve assembly. Thus, during cold start conditions, if the sensor detects that the control valve member is impacting without sufficient intensity and/or at a substantially delayed time period, an adjustment could be made to raise the initial pull-in current and/or move the start of current to an earlier time in order to cause the actual injection of fuel to occur at a desired point in time.

Those skilled in the art will appreciate that the electronic control module of the present invention performs numerous functions that are well known in the art. For instance, the electronic control module either has access to, or the ability to, generate baseline activation profiles which correspond to how, when and how much fuel is injected based upon each different set of operating conditions, such as engine speed, load, throttle position, etc. The present invention contemplates that the electronic control module would have additional capabilities relating to the ability to monitor the activation stage of each fuel injector, and possibly the ability to adjust the activation profiles based upon information provided by the control valve impact sensors. Thus, the electronic control module of the present invention would preferably include expected seat impact characteristics that would correspond to each of the baseline activation profiles. For instance, for a given activation profile, the expected seat impact characteristics would correspond to an intensity of the opening and closing valve events as well as when those impact events should occur based upon the activation profile. The present invention then contemplates comparing the expected seat impact characteristics to detected seat impact characteristics. If the sensed seat impact characteristics deviate greater than some predetermined threshold from the expected seat impact characteristics, there is an indication that the activation profile should be adjusted in order to bring the actual fuel injection event more in line with an expected injection profile. For instance, if the valve opening impact occurs at a time later than that expected, there is an indication that the start of injection is likely occurring for that fuel injector at a time later than the desired and expected start of injection. Therefore, the electronic control module might adjust that individual injector by making its start of current for the activation profile occur at an amount of time earlier than the nominal injector in order to cause the start of injection to occur as expected.

In another example, if the impact sensor detects that the amplitude of the valve impact is substantially greater than expected, this may be an indication of higher wear and/or power growth. If this condition is detected, the activation profile could be adjusted in terms of the on time and current level to reduce the valve impact to make the injector perform more in line with an expected nominal fuel injector. In some instances, the control valve impact sensor data could be used as a basis for changing the rail pressure map in order to achieve desirable performance. For instance, the sensor data for all of the injectors may indicate that all of the injector performances have a similar deviation that could be corrected by an adjustment in the actuation fluid pressure in the common rail. In other instances, a calculated adjustment to the activation profile may appear to exceed a predetermined maximum adjustment. In such a case, it may be that a rail pressure adjustment would be needed in order to achieve desirable performance.

In the preferred version of the present invention, the electronic control module also includes a sensor data recorder. By having the ability to record and compare a plurality of impact sensor data characteristics, the present invention could have a closed loop ability to fine tune each adjustment. For instance, the ability to record the sensor data could reveal that an adjustment based on previous sensor data either overcorrected or undercorrected for the sensed deviation from the desired performance. Thus, by recording and comparing a plurality of sensor data, the electronic control module would have the ability to further tweak an already adjusted activation profile to make an individual injector or a group of injectors perform in a manner more consistent with a nominal fuel injector.

It should be understood that the above description is intended only to illustrate the concepts of the present invention, and is not intended to limit the potential scope of the present invention. For instance, the principles of the present invention could apply to virtually any hydraulic device that is controlled in its operation by a valve member that impacts one or more seats when opening and/or closing. Furthermore, the principles of the present invention could be applied to fuel injectors or other hydraulic devices that have a pilot operated control valve assembly. In such a case, the impact characteristics of the pilot valve would be used to estimate the overall performance of the complete hydraulic device. Thus, those skilled in the art will appreciate that various modifications could be made to the illustrated embodiment without departing from the contemplated scope of the invention, which is defined by the claims set forth below.

What is claimed is:

1. An electronically controlled hydraulic system comprising:

at least one electronically controlled hydraulic device having a control valve member operably coupled to an electronic actuator, and said control valve member impacting a seat when said device is activated and deactivated;

said at least one electronically controlled hydraulic device including an additional valve member operably coupled to said control valve member and indirectly operably coupled to said electronic actuator;

an electronic control module in communication with and capable of controlling said electronic actuator, and having an activation profile generator, and further having an activation profile adjuster; and a control valve impact sensor in communication with said electronic control module.

2. The system of claim 1 wherein said hydraulic device is a hydraulically actuated fuel injector.

3. The system of claim 2 wherein said activation profile includes at least one of an ontime and a current level profile.

4. The system of claim 3 wherein said electronic control module includes a threshold deviation detector and a set of baseline activation profiles;

said activation profile adjuster includes at least one of an ontime adjustment and a current level profile adjustment that are a function of signals produced by said control valve impact sensor.

5. The system of claim 4 comprising a plurality of hydraulically actuated fuel injectors; and a separate control valve impact sensor mounted on each fuel injector.

6. The system of claim 5 wherein said electronic control module includes a sensor data recorder.

7. A method of monitoring performance of an electronically controlled hydraulic system comprising the steps of:

providing at least one electronically controlled hydraulic device having a control valve member operably coupled to an electronic actuator and an additional valve member operably coupled to said control valve member and indirectly operably coupled to said electronic actuator, said control valve member impacting a seat when said device is activated and deactivated;

activating said electronically controlled hydraulic device according to an activation profile;

detecting seat impacts of said control valve member;

recording detected seat impact characteristics; and comparing said detected seat impact characteristics to expected seat impact characteristics.

8. The method of claim 7 wherein said recording step includes a step of recording a timing of said seat impacts.

9. The method of claim 7 wherein said recording step includes a step of recording an intensity of said seat impacts.

10. The method of claim 7 wherein said expected seat impact characteristics correspond to a baseline activation profile.

11. The method of claim 7 wherein said detecting step includes a step of positioning a control valve impact sensor in acoustical proximity to said hydraulic device.

12. The method of claim 7 wherein said hydraulic device is a hydraulically actuated fuel injector; and said detecting step includes mounting a sensor on said fuel injector.

13. A method of adjusting performance of an electronically controlled hydraulic system comprising the steps of:

providing at least one electronically controlled hydraulic device having a control valve member operably coupled to an electronic actuator and an additional valve member operably coupled to said control valve member and indirectly operably coupled to said electronic actuator, said control valve member impacting a seat when said device is activated and deactivated;

activating said electronically controlled hydraulic device according to an activation profile;

detecting seat impacts of said control valve member;

recording detected seat impact characteristics;

comparing said detected seat impact characteristics to expected seat impact characteristics; and changing a subsequent activation profile it said detected seat impact characteristics are substantially different than said expected seat impact characteristics.

14. The method of claim 13 wherein said changing step includes altering an ontime portion of a subsequent activation profile.

15. The method of claim 13 wherein said changing step includes altering a current waveform portion of a subsequent activation profile.

16. The method of claim 13 wherein said hydraulic device is a hydraulically actuated fuel injector ; and said detecting step includes mounting a sensor on said fuel injector.

17. The method of claim 13 further comprising a step of changing a supply pressure of an actuation fluid connected to said hydraulic device if said detected seat impact characteristics are substantially different than said expected seat impact characteristics.

18. The method of claim 13 wherein said recording step includes a step of recording a timing of said seat impacts.

19. The method of claim 13 wherein said recording step includes a step of recording an intensity of said seat impacts.

20. The method of claim 13 wherein said expected seat impact characteristics correspond to a baseline activation profile.

21. An electronically controlled hydraulic system comprising:

at least one electronically controlled hydraulic device having a control valve member operably coupled to an electronic actuator, and said control valve member impacting a body when said device is activated and deactivated;

said at least one electronically controlled hydraulic device including an additional valve member operably coupled to said control valve member and indirectly operably coupled to said electronic actuator;

an electronic control module in communication with and capable of controlling said electronic actuator, and having an activation profile generator, and further having an activation profile adjuster; and a control valve impact sensor in communication with said electronic control module.

* * * * *